US010012231B2

(12) United States Patent
Muto

(10) Patent No.: US 10,012,231 B2
(45) Date of Patent: Jul. 3, 2018

(54) CLAW PUMP

(71) Applicant: ANEST IWATA Corporation, Kanagawa (JP)

(72) Inventor: Ryusuke Muto, Kanagawa (JP)

(73) Assignee: ANEST IWATA CORPORATION, Kanagawa (JP)

( * ) Notice: Subject to any disclaimer, the term of this patent is extended or adjusted under 35 U.S.C. 154(b) by 106 days.

(21) Appl. No.: 15/033,177

(22) PCT Filed: Nov. 4, 2014

(86) PCT No.: PCT/JP2014/079237
§ 371 (c)(1),
(2) Date: Apr. 29, 2016

(87) PCT Pub. No.: WO2015/068693
PCT Pub. Date: May 4, 2015

(65) Prior Publication Data

US 2016/0258435 A1 Sep. 8, 2016

(30) Foreign Application Priority Data

Nov. 5, 2013 (JP) ..... 2013-229741

(51) Int. Cl.
*F03C 2/00* (2006.01)
*F04C 18/12* (2006.01)
(Continued)

(52) U.S. Cl.
CPC ..... *F04C 18/123* (2013.01); *F01C 21/108* (2013.01); *F04C 28/14* (2013.01);
(Continued)

(58) Field of Classification Search
CPC .. F01C 21/108; F04C 18/123; F04C 2240/20; F04C 2250/10; F04C 29/12
See application file for complete search history.

(56) References Cited

U.S. PATENT DOCUMENTS 3,723,031 A 3/1973 Brown
4,324,538 A 4/1982 Brown
(Continued)

FOREIGN PATENT DOCUMENTS

CN 2204007 7/1995
CN 2276084 3/1998
(Continued)

OTHER PUBLICATIONS

English translation of International Preliminary Report on Patentability and Written Opinion of the International Searching Authority dated May 19, 2016 in International (PCT) Application No. PCT/JP2014/079237.

(Continued)

*Primary Examiner* — Mark Laurenzi
*Assistant Examiner* — Anthony Ayala Delgado
(74) *Attorney, Agent, or Firm* — Wenderoth, Lind & Ponack, L.L.P.

(57) ABSTRACT

A claw pump includes: a housing; two rotating shafts which are disposed parallel; a pair of rotors respectively fixed to the two rotating shafts; a rotary drive device driving the pair of rotors; and a suction port and discharge ports formed in a partition wall of the housing. The discharge ports are constituted by a first discharge port and a second discharge port. The first discharge port is formed at a position that communicates with an initial stage compression space formed at an initial stage of a compression stroke in a compression space that is formed by joining a first pocket and a second pocket. The claw pump includes an opening/closing mechanism which opens the first discharge port when a pressure of the initial stage compression space reaches a threshold and closes the first discharge port when the pressure does not reach the threshold.

7 Claims, 5 Drawing Sheets

(51) Int. Cl.

| | |
|---|---|
| ***F04C 29/12*** | (2006.01) |
| ***F01C 21/10*** | (2006.01) |
| ***F04C 28/14*** | (2006.01) |

(52) U.S. Cl.

CPC ..... *F04C 29/12* (2013.01); *F04C 2240/20* (2013.01); *F04C 2250/10* (2013.01); *F04C 2270/195* (2013.01)

(56) References Cited

U.S. PATENT DOCUMENTS

| | | | | |
|---|---|---|---|---|
| 8,517,701 | B2 * | 8/2013 | Tanigawa ..... | F01C 19/005 418/150 |
| 8,801,402 | B2 | 8/2014 | Chu et al. | |
| 2011/0236232 | A1 | 9/2011 | Chu et al. | |

FOREIGN PATENT DOCUMENTS

| | | |
|---|---|---|
| CN | 1715654 | 1/2006 |
| EP | 0 502 684 | 9/1992 |
| FR | 983 881 | 6/1951 |
| JP | 6-101673 | 4/1994 |
| JP | 2011-38476 | 2/2011 |
| JP | 3168851 | 6/2011 |
| JP | 2013-76361 | 4/2013 |

OTHER PUBLICATIONS

Extended European Search Report dated May 26, 2017 in corresponding European Application No. 14859606.7.

International Search Report dated Jan. 27, 2015 in International (PCT) Application No. PCT/JP2014/079237.

* cited by examiner

VIEWED FROM ARROW A

CLAW PUMP

TECHNICAL FIELD

The present invention relates to a claw pump capable of reducing the temperature of discharge gas.

BACKGROUND ART

A claw pump includes a pair of rotors which have hook-shaped claws formed thereon and rotate in opposite directions to each other at the same speed in a non-contact manner while maintaining an extremely narrow clearance therebetween inside a housing that forms a pump chamber. The two rotors form a compression pocket, and compressed gas compressed in the compression pocket is discharged through a discharge port. The claw pump continuously performs suction, compression, and exhaust without using a lubricating oil or sealing liquid, thereby producing a vacuum state or pressurized air. As described above, since the lubricating oil or the like is not used, there are advantages that clean gas can be exhausted and discharged, and a higher compression ratio than that of a Roots pump that does not have a compression stroke can be realized.

FIG. 5 illustrates an example of a claw pump according to the related art. In FIG. 5, a claw pump 100 includes a housing 102 that forms a pump chamber therein, and the housing 102 has a cross-sectional shape of two partially overlapping circles. Both end faces of the housing 102 are blocked by side plates (not illustrated), and a suction port 108 is formed in a circumferential wall of the housing 102. Two parallel rotating shafts 110*a* and 110*b* are provided inside the housing 102, and rotors 112*a* and 112*b* are respectively fixed to the rotating shafts 110*a* and 110*b*. The rotors 112*a* and 112*b* are provided with hook-shaped claws 114*a* and 114*b* which mesh each other in a non-contact manner.

The rotors 112*a* and 112*b* rotate in opposite directions to each other (arrow directions), and gas g is suctioned into an inlet pocket $P_0$ that communicates with the suction port 108. Thereafter, two pockets $P_1$ and $P_2$ are formed as the rotors 112*a* and 112*b* rotate (see FIG. 5(D)). Furthermore, the two pockets $P_1$ and $P_2$ join and form a compression pocket P (see FIG. 5(F)). In the compression pocket P, immediately after the pockets $P_1$ and $P_2$ join, an initial stage compression space Pe is formed. Thereafter, the initial stage compression space Pe is reduced as the rotors 112*a* and 112*b* rotate, such that an end stage compression space Pc is formed. The discharge port 116 is formed in one of the side plates at a position that communicates with the end stage compression space Pc. The gas g is compressed in the compression pocket P and is discharged from the discharge port 116.

In the claw pump, the gas is increased in temperature by compressing the gas, while a higher compression ratio than that of a Roots pump can be realized. The high-temperature gas comes into contact with the surrounding components and increases the temperatures thereof. Therefore, there is concern that contact between the claws of the rotors or contact between the claws and the inner surfaces of the housing may occur due to thermal expansion or deformation and breaking may occur due to insufficient heat resistance. To solve the problems, there is proposed a method of changing the shape of the discharge port or providing a plurality of discharge ports to increase the area of openings, reduce pressure loss, and prevent excessive compression, thereby preventing an increase in temperature. For example, in Patent Literature 1, there is disclosed an example in which discharge ports are formed in both of a pair of side plates that block both end faces of a housing to increase the area of openings.

Otherwise, there has been an attempt to prevent an increase in temperature by reducing a compression ratio through a study of the shape of rotors. For example, in Patent Literature 2, there is disclosed a configuration in which a dent is formed in a face of a convex portion of a female rotor, which faces a claw of a male rotor, and gas in a compression pocket is allowed to escape to the dent when the compression pocket becomes distant from a discharge port, thereby relaxing excessive compression.

In general, a claw pump suctions cooled outside air to obtain a cooling effect. However, in a case where the claw pump is particularly used as a vacuum pump, since the inflow of gas from the suction port is significantly reduced during an operation at a suction pressure of about the ultimate pressure, the cooling effect cannot be obtained. In addition, since the pump chamber is in a vacuum state, a pressure difference from the discharge side occurs, and there is concern that high-temperature gas discharged from the discharge port may flow back to the pump chamber. When the discharge gas that flows back to the pump chamber due to the backflow phenomenon is recompressed while maintaining a high temperature, the temperature thereof is further increased. Accordingly, there may be cases where the temperature of the discharge gas reaches 200° C. to 300° C. As a countermeasure, a method of providing a check valve in the outlet of the discharge port to prevent the backflow of the high-temperature gas is considered.

CITATION LIST

Patent Literature

Patent Literature 1: Japanese Unexamined Patent Publication No. 2011-038476

Patent Literature 2: Japanese Unexamined Patent Publication No. 2013-076361

SUMMARY OF INVENTION

Technical Problem

However, in the method of changing the shape of the discharge port or increasing the area of openings as a countermeasure to prevent an increase in the temperature of the discharge gas, there is concern that the compression ratio may decrease, and desired performance cannot be exhibited, and the backflow of the high-temperature gas cannot be prevented. In addition, in the method of studying the shape of the rotor, there is concern that the shape of the rotor may become complex and design costs and production costs of the rotor may increase. Furthermore, in the method of providing a check valve in the outlet of the discharge port, there is concern that the flow resistance of the gas may be increased due to the installation of the check valve, which leads to excessive compression of the gas on the contrary, resulting in an increase in the gas temperature.

In order to solve the aforementioned problems, an object of the present invention is to reduce the temperature of a discharge gas of a claw pump with low-cost means.

Solution to Problem

In order to accomplish the object, the present invention is applied to a claw pump including: a housing which forms a pump chamber having a cross-sectional shape of two partially overlapping circles; two rotating shafts which are disposed parallel to each other inside the housing and synchronously rotated in opposite directions to each other; a pair of rotors which are respectively fixed to the two rotating shafts inside the housing, each of the rotors being provided with two or more hook-shaped claws, the claws meshing with each other in a non-contact state; a rotary drive device which drives the pair of rotors to rotate via the two rotating shafts; and a suction port and discharge ports which are formed in a partition wall of the housing and communicate with the pump chamber.

According to an aspect of the present invention, the discharge ports are respectively formed in side plates which form both axial end faces of the rotating shafts of the housing and are constituted by a first discharge port and a second discharge port which are formed at positions that communicate with a compression pocket formed by a set of the claws. The claw pump includes an opening/closing mechanism of the first discharge port and the second discharge port for, while the pair of rotors rotate one revolution, discharging gas in the compression pocket formed by at least one set of the claws only via the first discharge port and discharging the gas in the compression pocket formed by at least another set of the claws only via the second discharge port, is included.

In a case where two or more claws are provided in a single rotor, discharge gas is discharged two or more times while the rotor makes one revolution. Therefore, when the discharge gas is discharged from a single discharge port, the discharge interval is shortened, with a backflow phenomenon of the discharge gas that is increased in temperature, the temperature of the discharge gas is increased. In the aspect of the present invention, in the above-described configuration, the gas compressed in the compression pocket can be dispersed toward the first discharge port and the second discharge port so as to be discharged while the pair of rotors rotate one revolution. Accordingly, the discharge interval of the first discharge port or the second discharge port can be increased, and the time until the discharge gas that is compressed and is increased in temperature flows back to the discharge port can be increased. Therefore, the time for which the discharged gas is mixed with cooled outside gas so as to be cooled can be increased. Accordingly, gas at a lower temperature than that according to the related art flows back to the discharge port and thus the initial temperature of the gas that is recompressed after flowing backward can be reduced. Therefore, an excessive increase in the temperature of the discharge gas after recompression can be prevented.

As a result, the temperature of the discharge gas that is recompressed can be lowered, and an increase in the temperatures of components that come into contact with the discharge gas can be suppressed. Accordingly, contact between the claws of the rotors or contact between the claws and the inner surfaces of the housing due to thermal expansion or deformation and breaking due to insufficient heat resistance can be suppressed. In addition, the amount of thermal expansion of each of the components decreases. Therefore, as the amount of thermal expansion decreases, the gaps between the components can be further reduced, which leads to an increase in pump efficiency. Furthermore, the degree of request of each of the components for heat resistance can be reduced, and thus a reduction in costs can be achieved.

According to an aspect of the present invention, the opening/closing mechanism can be constituted by a first partition plate and a second partition plate, which are fixed to one of the two rotating shafts on both sides of the pair of rotors in a rotational axis direction. In addition, the first partition plate is provided with an opening formed at a position that opens only the first discharge port and does not open the second discharge port when at least one set of the claws forms the compression pocket in the housing, and the second partition plate is provided with an opening formed at a position that opens only the second discharge port and does not open the first discharge port when at least another set of the claws forms the compression pocket in the housing.

As described above, since the first partition plate and the second partition plate are used as the opening/closing mechanism, a wide installation space is not necessary. In addition, since the first partition plate and the second partition plate are fixed to the rotating shaft and are interlocked with the rotating shaft, a special drive device is not necessary, and the opening/closing mechanism can be simply formed with low costs.

According to an aspect of the present invention, in a case where two claws are formed on each of the rotors, the first partition plate is provided with the opening formed at a position that opens only the first discharge port and does not open the second discharge port when one set of the claws forms the compression pocket in the housing. In addition, the second partition plate is provided with the opening formed at a position that opens only the second discharge port and does not open the first discharge port when the other set of the claws forms the compression pocket in the housing.

In this configuration, the gas in the compression pocket is alternately discharged to the first discharge port and the second discharge port. In a claw pump having two claws for a single rotor, compressed gas is discharged from a single discharge port every half revolution. On the contrary, in the above-descried configuration, the compressed gas is discharged from a single discharge port every one revolution. Therefore, the time until the discharge gas that is compressed and is increased in temperature flows backward is increased twice that of the claw pump according to the related art. Therefore, an excessive increase in the temperature of the discharge gas after recompression can be effectively prevented.

According to an aspect of the present invention, in a case where three claws are formed on each of the rotors at equal intervals in a circumferential direction, the first partition plate is provided with the opening formed at a position that opens only the first discharge port and does not open the second discharge port when two sets of the claws form the compression pocket in the housing, and the second partition plate is provided with the opening formed at a position that opens only the second discharge port and does not open the first discharge port when another set of the claws forms the compression pocket in the housing. Accordingly, even in the case where three claws are formed on a single rotor, the time at which the compressed gas is discharged from a single discharge port can be increased, and thus gas at a lower temperature flows backward. Therefore, an excessive increase in the temperature of the discharge gas after recompression can be prevented.

According to an aspect of the present invention, the first partition plate and the second partition plate can be disposed between the pair of rotors and the side plates. Accordingly, a space in which the first partition plate and the second partition plate are disposed outside the housing is not necessary, and a compact pump configuration can be achieved.

If there is no restrictions on space, the first partition plate and the second partition plate may also be disposed on the outside of the side plates. In this case, the management of gaps in the axial direction of the rotating shaft can be performed with lower accuracy than that of the housing, and workability and ease of assembly can be improved. Otherwise, the first partition plate and the second partition plate disposed on the outside of the side plates may be provided with blades, for example, in a structure such as a sirocco fan, to actively discharge the discharge gas to the outside. Accordingly, the backflow of high-temperature gas can be further suppressed.

Advantageous Effects of Invention

According to some aspects of the present invention, the temperature of the discharge gas of the claw pump can be reduced by simple and low-cost means. Therefore, various problems caused by an increase in the temperature of the discharge gas can be solved.

DESCRIPTION OF EMBODIMENTS

Figure 1:
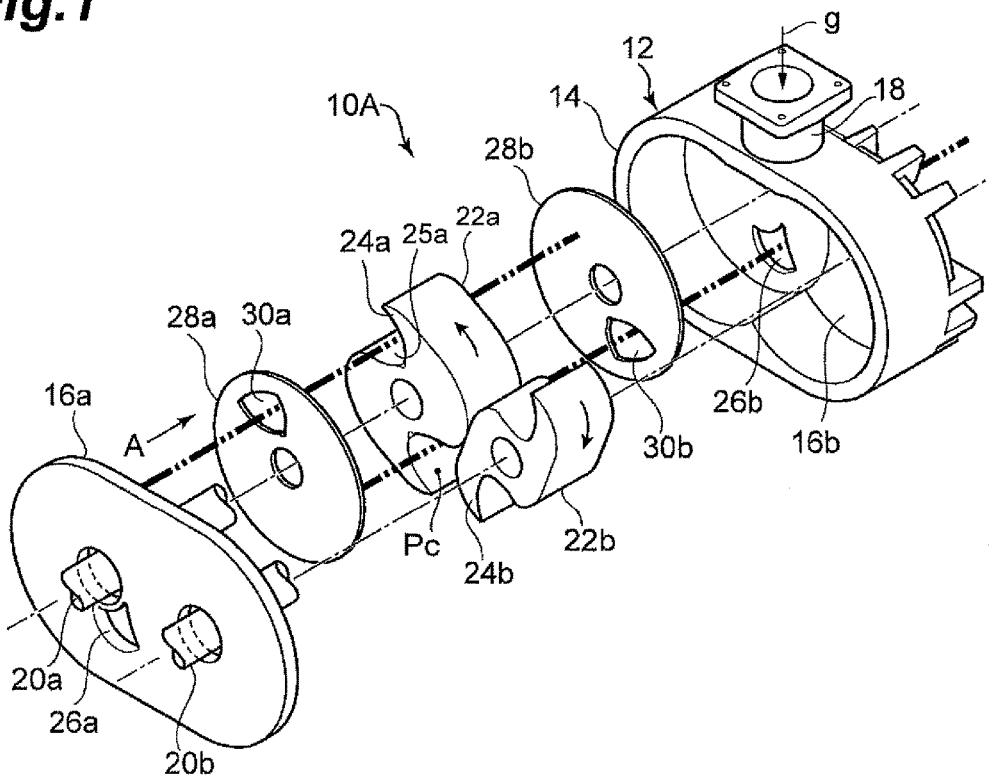
FIG. 1 is an exploded perspective view of a claw pump according to a first embodiment of the present invention.

Hereinafter, the present invention will be described in detail using embodiments illustrated in the drawings. Here, the dimensions, materials, shapes, and relative arrangements of components described in the embodiments are not intended to limit the scope of the invention thereto if not particularly defined.

(First Embodiment)

Figure 2:
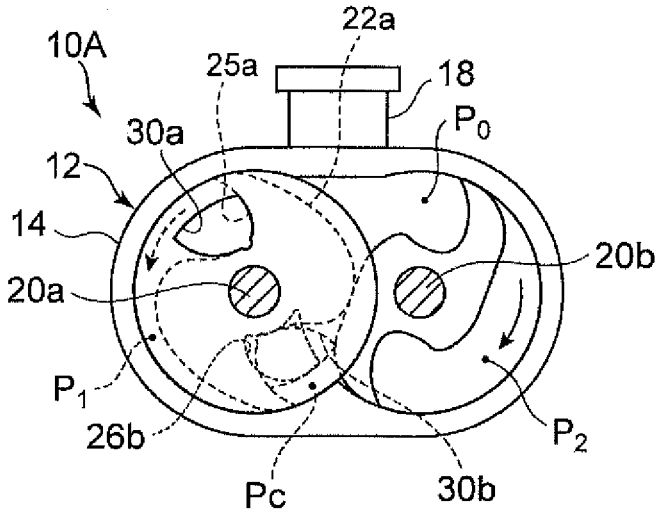
FIG. 2 is a view viewed from arrow A in FIG. 1.
Figure 3:
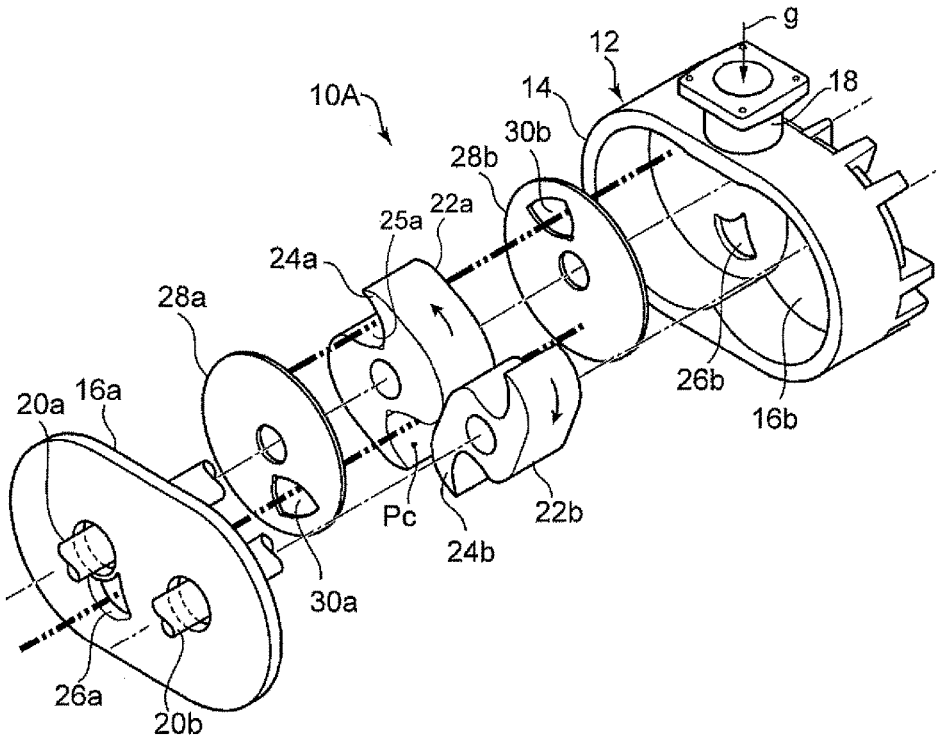
FIG. 3 is an exploded perspective view illustrating a state after the claw pump makes a half revolution.

Next, a claw pump according to a first embodiment of the present invention will be described with reference to FIGS. 1 to 3. In FIGS. 1 and 2, a claw pump 10A according to the embodiment includes a housing 12 that forms a pump chamber therein. The housing 12 is constituted by a cylinder 14 having a cross-sectional shape of two partially overlapping circles, and a pair of side plates 16*a* and 16*b* which block both end faces of the cylinder 14. The cylinder 14 is provided with a suction port 18, and the suction port 18 is disposed at a position that communicates with an inlet pocket $P_0$ in which suctioned gas g is not compressed.

Inside the housing 12, two rotating shafts 20*a* and 20*b* are arranged parallel to each other. Inside the housing 12, rotors 22*a* and 22*b* are respectively fixed to the rotating shafts 20*a* and 20*b*. The rotating shafts 20*a* and 20*b* extend toward the outside of the housing 12, and end portions of the rotating shafts 20*a* and 20*b* are connected to a rotary drive device (not illustrated). The rotating shafts 20*a* and 20*b* are synchronously rotated in opposite directions to each other by the rotary drive device. The rotors 22*a* and 22*b* are rotated in the opposite directions to each other at the same speed by the rotary drive device. The rotors 22*a* and 22*b* are provided with two claws 24*a* and two claws 24*b* which have a hook shape and mesh with each other in a non-contact state (with a fine gap therebetween). The two claws are disposed at positions at 180 degrees to each other in the circumferential direction. The rotor 22*a* is provided with a first concave portion 25*a* formed on the downstream side of the first claw 24*a*. The rotor 22*a* is provided with a second concave portion 25*a* formed on the downstream side of the second claw 24*a*. Here, the downstream side mentioned here is the downstream side with respect to the rotational direction of the rotor 22*a*.

The gas g is suctioned into the inlet pocket $P_0$ from the suction port 18 by the rotation of the rotors 22*a* and 22*b*. Next, the inlet pocket $P_0$ into which the gas g flows is divided into a first pocket $P_1$ enclosed by the housing 12 and the rotor 22*a*, and a second pocket $P_2$ enclosed by the housing 12 and the rotor 22*b*. As the rotors 22*a* and 22*b* further rotate, the first pocket $P_1$ and the second pocket $P_2$ join such that a compression pocket P is formed. Immediately after the joining, an initial stage compression space Pe is formed. Thereafter, the compression pocket P is reduced in size and an end stage compression space Pc is formed. In this compression process, the gas g in the compression pocket P is compressed.

The side plates 16*a* and 16*b* are respectively provided with discharge ports 26*a* and 26*b* which are formed in regions closer to the rotating shaft 20*a* than the rotating shaft 20*b*. The discharge ports 26*a* and 26*b* are disposed at positions which communicate with the end stage compression space Pc when the end stage compression space Pc is formed by the claws 24*a* and 24*b*. The discharge ports 26*a* and 26*b* are disposed at the same position in the circumferential direction of the rotating shaft 20*a* and have the same shape.

A partition plate 28*a* having a circular outer shape is fixed to the rotating shaft 20*a* between the side plate 16*a* and the rotor 22*a* inside the housing 12. In addition, a partition plate 28*b* having a circular outer shape is fixed to the rotating shaft 20*a* between the side plate 16*b* and the rotor 22*a*. The partition plates 28*a* and 28*b* are respectively provided with openings 30*a* and 30*b*. The openings 30*a* and 30*b* are disposed substantially in the same region in the radial direction from the rotating shaft 20*a*. The openings 30*a* and 30*b* are disposed at positions at 180 degrees to each other about the rotating shaft 20*a* in the circumferential direction. In other words, the openings 30*a* and 30*b* are formed to substantially have point symmetry (that is, twofold symmetry) about the rotating shaft 20*a*. Fine gaps are provided between the outer circumferences of the partition plates 28*a* and 28*b* and the inner circumference of the housing 12 to an extent that the gas g does not leak.

More specifically, the opening 30*a* overlaps the first concave portion 25*a* formed on the downstream side of the first claw 24*a* of the rotor 22*a*. The opening 30*a* is disposed at a position that overlaps discharge port 26*a* when a first set of the claws 24*a* and 24*b* (one set of claws) of the rotors 22*a* and 22*b* forms the end stage compression space Pc to enable the end stage compression space Pc and the discharge port 26*a* to communicate with each other. The opening 30*b* overlaps the second concave portion 25*a* formed on the downstream side of the second claw 24*a* of the rotor 22*a*. The opening 30*b* is disposed at a position that overlaps discharge port 26*b* when a second set of the claws 24*a* and 24*b* (the other set of claws) of the rotors 22*a* and 22*b* forms the end stage compression space Pc to enable the end stage compression space Pc and the discharge port 26*b* to communicate with each other.

In this configuration, when the first set of claws 24*a* and 24*b* forms the end stage compression space Pc, the compressed gas in the end stage compression space Pc is discharged from the discharge port 26*a* via the opening 30*a*. Next, when the second set of claws 24*a* and 24*b* forms the end stage compression space Pc, the compressed gas in the end stage compression space Pc is discharged from the discharge port 26*b* via the opening 30*b*. Therefore, the compressed gas is alternately discharged from the discharge ports 26*a* and 26*b*. FIG. 1 illustrates a state in which the end stage compression space Pc formed by the claws 24*a* and 24*b* and the discharge port 26*b* communicate with each other via the opening 30*b* of the partition plate 28*b*. FIG. 3 illustrates a state in which the rotors 22*a* and 22*b* make a half revolution from the state of FIG. 1 and the end stage compression space Pc and the discharge port 26*a* communicate with each other via the opening 30*a* of the partition plate 28*a*.

According to this embodiment, since the compressed gas is alternately discharged from the discharge ports 26*a* and 26*b*, compared to a claw pump according to the related art, the interval at which the discharge gas is discharged from the discharge ports 26*a* and 26*b* can be increased twice. Therefore, the time for which the discharged gas is mixed with cooled outside gas so as to be cooled can be increased. Accordingly, in a case where the pump chamber is at a low pressure, gas at a lower temperature than that according to the related art flows back to the discharge port and thus the initial temperature of the gas that is recompressed after flowing backward can be reduced. Therefore, an excessive increase in the temperature of the discharge gas after recompression can be prevented.

As a result, the temperature of the discharge gas that is recompressed can be lowered, and an increase in the temperatures of components that come into contact with the discharge gas can be suppressed. Therefore, contact between the claws 24*a* and 24*b* of the rotors 22*a* and 22*b* or contact between the claws 24*a* and 24*b* and the inner surfaces of the housing 12 due to thermal expansion or deformation and breaking due to insufficient heat resistance can be suppressed. In addition, the amount of thermal expansion of each of the components decreases. Therefore, as the amount of thermal expansion decreases, the gaps between the components can be further reduced, which leads to an increase in pump efficiency. Furthermore, the degree of request of each of the components for heat resistance can be reduced, and thus a reduction in costs can be achieved.

In addition, since only the partition plates 28*a* and 28*b* need to be used, a wide installation space is not necessary. In addition, since the partition plates 28*a* and 28*b* are fixed to the rotating shaft 20*a* and are interlocked with the rotating shaft 20*a*, a special drive device is not necessary, and an opening/closing mechanism can be simply formed with low costs. Furthermore, since the partition plates 28*a* and 28*b* are disposed between the rotors 22*a* and 22*b* and the right and left side plates 16*a* and 16*b*, a space in which the partition plates 28*a* and 28*b* are disposed outside the housing 12 is not necessary, and a compact pump configuration can be achieved.

(Second Embodiment)

Figure 4:
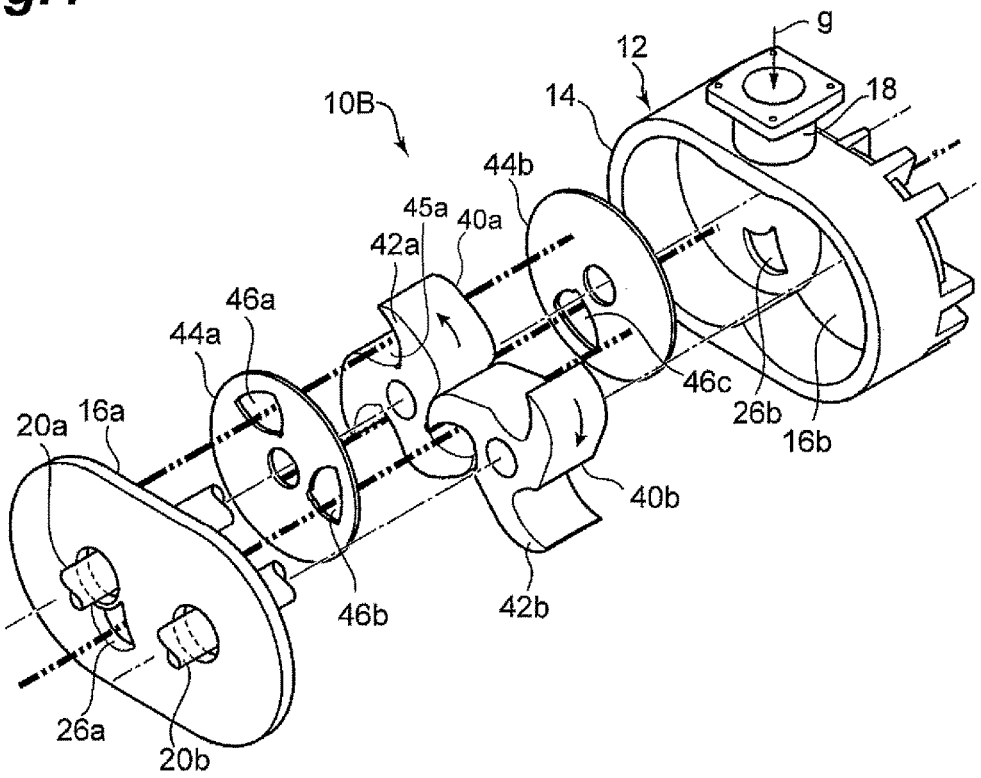
FIG. 4 is an exploded perspective view of a claw pump according to a second embodiment of the present invention.
Figure 5:
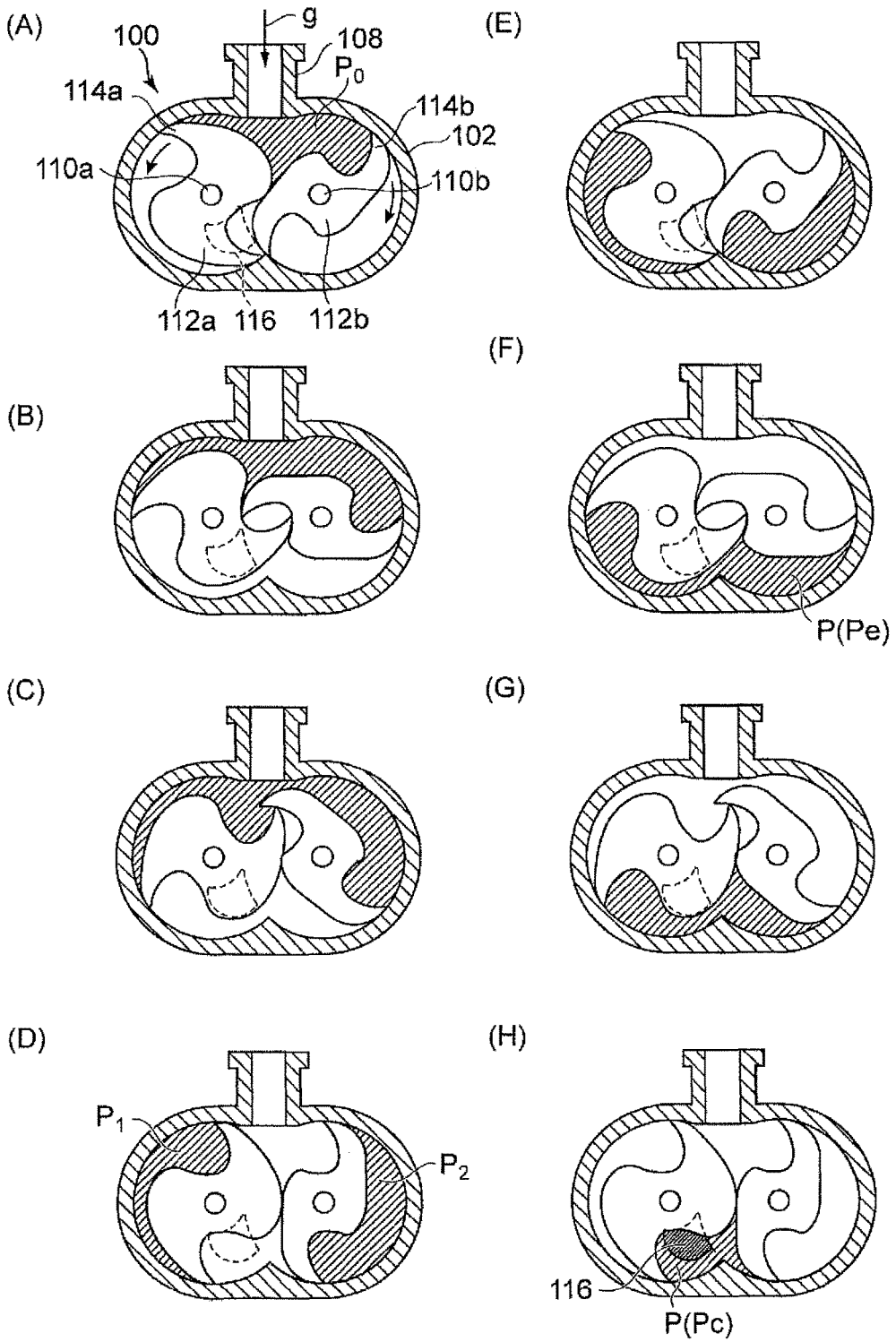
FIGS. 5(A) to 5(H) are front sectional views illustrating a claw pump according to the related art in a stroke order.

Next, a second embodiment of the present invention will be described with reference to FIG. 4. In a claw pump 10B according to this embodiment, a pair of rotors 40*a* and 40*b* are provided with three claws 42*a* and three claws 42*b* having a hook shape. The claws 42*a* or 42*b* are disposed at equal intervals in the circumferential direction of the rotor 40*a* or 40*b*. The rotor 40*a* is provided with a first concave portion 45*a* formed on the downstream side of the first claw 42*a*. The rotor 40*a* is provided with a second concave portion 45*a* formed on the downstream side of the second claw 42*a*. The rotor 40*a* is provided with a third concave portion 45*a* formed on the downstream side of the third claw 42*a*. A partition plate 44*a* having a circular outer shape is fixed to the rotating shaft 20*a* between the side plate 16*a* and the rotor 40*a*. In addition, a partition plate 44*b* having a circular outer shape is fixed to the rotating shaft 20*a* between the side plate 16*b* and the rotor 40*a*.

Two openings 46*a* and 46*b* are bored in the partition plate 44*a*, and a single opening 46*c* is bored in the partition plate 44*b*. The openings 46*a*, 46*b*, and 46*c* are disposed at substantially the same position in the radial direction from the rotating shaft 20*a*. The openings 46*a*, 46*b*, and 46*c* are disposed at equal intervals of 120 degrees in the circumferential direction about the rotating shaft 20*a*. In other words, the openings 46*a*, 46*b*, and 46*c* are formed to have threefold symmetry about the rotating shaft 20*a*. In addition, fine gaps are provided between the outer circumferences of the partition plates 44*a* and 44*b* and the inner circumference of the housing 12 to an extent that the gas g does not leak.

More specifically, the opening 46*a* overlaps the first concave portion 45*a* formed on the downstream side of the first claw 42*a* of the rotor 40*a*. The opening 46*a* is disposed at a position that overlaps discharge port 26*a* when a first set of the claws 42*a* and 42*b* (one set of claws) of the rotors 40*a* and 40*b* forms the end stage compression space Pc to enable the end stage compression space Pc and the discharge port 26*a* to communicate with each other. The opening 46*b* overlaps the second concave portion 45*a* formed on the downstream side of the second claw 42*a* of the rotor 40*a*. The opening 46*b* is disposed at a position that overlaps discharge port 26*a* when a second set of the claws 42*a* and 42*b* (another set of claws) of the rotors 40*a* and 40*b* forms the end stage compression space Pc to enable the end stage compression space Pc and the discharge port 26*a* to communicate with each other. The opening 46*c* overlaps the third concave portion 45*a* formed on the downstream side of the third claw 42*a* of the rotor 40*a*. The opening 46*c* is disposed at a position that overlaps discharge port 26*b* when a third set of the claws 42*a* and 42*b* (yet another set of claws) of the rotors 40*a* and 40*b* forms the end stage compression space Pc to enable the end stage compression space Pc and the discharge port 26*b* to communicate with each other. The other configurations are the same as those of the first embodiment.

In this configuration, when the first set of claws 42*a* and 42*b* forms the end stage compression space Pc, the compressed gas in the end stage compression space Pc is discharged from the discharge port 26*a* via the opening 46*a*. Next, when the rotors 40*a* and 40*b* rotate 120 degrees and the second set of claws 42*a* and 42*b* forms the end stage compression space Pc, the compressed gas in the end stage compression space Pc is discharged from the discharge port 26*a* via the opening 46*b*. When the rotors 40*a* and 40*b* further rotate 120 degrees and the third set of claws 42*a* and 42*b* (the remaining set of claws) forms the end stage compression space Pc, the compressed gas in the end stage compression space Pc is discharged from the discharge port 26*b* via the opening 46*c*.

According to this embodiment, the time interval at which the compressed gas is discharged from the discharge ports 26*a* and 26*b* can be increased, and thus the gas at a lower temperature flows backward. Therefore, an excessive increase in the temperature of the discharge gas after recompression can be prevented.

INDUSTRIAL APPLICABILITY

According to the embodiment, a claw pump in which an increase in the temperature of a discharge gas can be avoided and problems caused by the temperature increase can be solved can be realized by simple and low-cost means.

REFERENCE SIGNS LIST

10A, 10B, 100 CLAW PUMP
12, 102 HOUSING
14 CYLINDER
16*a*, 16*b* SIDE PLATE
18, 108 SUCTION PORT
20*a*, 20*b*, 110*a*, 110*b* ROTATING SHAFT
22*a*, 22*b*, 40*a*, 40*b*, 112*a*, 112*b* ROTOR
24*a*, 24*b*, 42*a*, 42*b*, 114*a*, 114*b* CLAW
26*a*, 26*b* DISCHARGE PORT
28*a*, 28*b*, 44*a*, 44*b* PARTITION PLATE
30*a*, 30*b*, 46*a*, 46*b*, 46*c* OPENING
116 DISCHARGE PORT
P COMPRESSION POCKET
Pe INITIAL STAGE COMPRESSION SPACE
Pc END STAGE COMPRESSION SPACE
$P_0$ INLET POCKET
$P_1$ FIRST POCKET
$P_2$ SECOND POCKET
g GAS

The invention claimed is:

1. A claw pump comprising:

a housing including two side plates and a pump chamber formed between the two side plates, the pump chamber having a cross-sectional shape of two partially overlapping circles;

two rotating shafts which are disposed parallel to each other inside the housing and are synchronously rotated in opposite directions to each other;

a pair of rotors which are respectively fixed to the two rotating shafts inside the housing, each of the rotors being provided with two or more hook-shaped claws, the claws meshing with each other in a non-contact state;

a rotary drive device which is configured to drive the pair of rotors so as to be rotated via the two rotating shafts;

a suction port and discharge ports which are formed in a partition wall of the housing and communicate with the pump chamber, the discharge ports being respectively formed in the two side plates of the rotating shafts of the housing and being constituted by a first discharge port and a second discharge port which are formed at positions that communicate with a compression pocket formed by a set of the claws; and an opening/closing mechanism of the first discharge port and the second discharge port which is configured to discharge gas in the compression pocket formed by at least one set of the claws only via the first discharge port and to discharge the gas in the compression pocket formed by at least another set of the claws only via the second discharge port, while the pair of rotors rotate one revolution.

2. The claw pump according to claim 1, wherein the opening/closing mechanism is constituted by a first partition plate and a second partition plate, which are fixed to one of the two rotating shafts on opposite sides of the pair of rotors, the first partition plate is provided with an opening formed at a position that opens only the first discharge port when the at least one set of the claws forms the compression pocket in the housing, and the second partition plate is provided with an opening formed at a position that opens only the second discharge port when the at least another set of the claws forms the compression pocket in the housing.

3. The claw pump according to claim 2, wherein the claws comprise two claws formed on each of the pair of rotors at opposite positions to each other, the first partition plate is provided with the opening formed at a position that opens only the first discharge port when one set of the claws forms the compression pocket in the housing, and the second partition plate is provided with the opening formed at a position that opens only the second discharge port when another set of the claws forms the compression pocket in the housing.

4. The claw pump according to claim 3, wherein the first partition plate and the second partition plate are disposed between the pair of rotors and the side plates.

5. The claw pump according to claim 2, wherein the claws comprise three claws formed on each of the pair of rotors at equal intervals in a circumferential direction, the first partition plate is provided with the opening formed at a position that opens only the first discharge port when two sets of the claws form the compression pocket in the housing, and the second partition plate is provided with the opening formed at a position that opens only the second discharge port when another set of the claws forms the compression pocket in the housing.

6. The claw pump according to claim 5, wherein the first partition plate and the second partition plate are disposed between the pair of rotors and the side plates.

7. The claw pump according to claim 2, wherein the first partition plate and the second partition plate are disposed between the pair of rotors and the side plates.

* * * * *